US012054871B2

(12) United States Patent
Worley et al.

(10) Patent No.: US 12,054,871 B2
(45) Date of Patent: Aug. 6, 2024

(54) WASHING MACHINE APPLIANCE LOAD SIZE DETECTION USING DECELERATION TIME

(71) Applicant: Haier US Appliance Solutions, Inc., Wilmington, DE (US)

(72) Inventors: Mark William Thomas Worley, Louisville, KY (US); Stannard Nathan Phelps, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/833,023

(22) Filed: Jun. 6, 2022

(65) Prior Publication Data

US 2023/0392314 A1 Dec. 7, 2023

(51) Int. Cl.

| | |
|---|---|
| ***D06F 33/40*** | (2020.01) |
| ***D06F 34/18*** | (2020.01) |
| ***D06F 37/30*** | (2020.01) |
| ***D06F 37/36*** | (2006.01) |
| *D06F 103/04* | (2020.01) |
| *D06F 105/48* | (2020.01) |

(52) U.S. Cl.

CPC ..... *D06F 33/40* (2020.02); *D06F 34/18* (2020.02); *D06F 37/304* (2013.01); *D06F 37/36* (2013.01); *D06F 2103/04* (2020.02); *D06F 2105/48* (2020.02)

(58) Field of Classification Search

CPC ..... D06F 33/40

See application file for complete search history.

(56) References Cited

U.S. PATENT DOCUMENTS

| | | | |
|---|---|---|---|
| 8,042,211 | B2 | 10/2011 | Stansel et al. |
| 8,813,288 | B2 | 8/2014 | Bhandwale et al. |
| 8,914,930 | B2 | 12/2014 | Chanda et al. |
| 8,932,369 | B2 | 1/2015 | Miller et al. |
| 9,096,964 | B2 | 8/2015 | Albayrak et al. |
| 9,200,401 | B2 | 12/2015 | Chung et al. |
| 9,371,607 | B2 | 6/2016 | Pascualena et al. |
| 9,840,805 | B2 | 12/2017 | Leonard et al. |
| 9,863,080 | B2 | 1/2018 | Fugal et al. |

(Continued)

FOREIGN PATENT DOCUMENTS

| | | | |
|---|---|---|---|
| WO | WO2014191248 | A1 | 12/2014 |
| WO | WO2020050621 | A1 | 3/2020 |

*Primary Examiner* — Jason Y Ko

(74) *Attorney, Agent, or Firm* — Dority & Manning, P.A.

(57) ABSTRACT

A washing machine appliance and methods of operating a washing machine appliance are provided. The washing machine appliance includes a motor and a rotatable basket. The motor is operated to rotate the basket to a first speed. The basket is then decelerated from the first speed to a second speed less than the first speed. A deceleration time is determined while decelerating the basket from the first speed to the second speed. The method may include, or the washing machine appliance may be configured for, determining a size of a load of articles in the basket of the washing machine appliance based on the deceleration time. Based on the determined size of the load, one or more operating parameters of the washing machine appliance are selected and an operation of the washing machine appliance is performed according to the one or more selected operating parameters.

18 Claims, 4 Drawing Sheets

(56) References Cited

U.S. PATENT DOCUMENTS

| | | | | |
|---|---|---|---|---|
| 9,890,490 | B2 | 2/2018 | Janke et al. | |
| 9,890,492 | B2 | 2/2018 | Melo et al. | |
| 10,041,202 | B2 | 8/2018 | Sumer et al. | |
| 10,047,470 | B2 | 8/2018 | Kim et al. | |
| 10,301,762 | B2 | 5/2019 | Sumer et al. | |
| 2008/0178398 | A1 | 7/2008 | Darby et al. | |
| 2010/0154131 | A1* | 6/2010 | Paul | D06F 34/18 68/12.02 |
| 2015/0292137 | A1 | 10/2015 | Leonard et al. | |

* cited by examiner

WASHING MACHINE APPLIANCE LOAD SIZE DETECTION USING DECELERATION TIME

FIELD OF THE INVENTION

The present subject matter relates generally to washing machine appliances and methods for operating washing machine appliances, and more particularly to systems and methods for detecting a size of a load of articles in such appliances.

BACKGROUND OF THE INVENTION

Washing machine appliances generally include a tub for containing washing fluid, e.g., water, detergent, and/or bleach, during operation of such washing machine appliances. A basket is rotatably mounted within the tub and defines a wash chamber for receipt of articles for washing. During operation of such washing machine appliances, washing fluid is directed into the tub and onto articles within the wash chamber of the basket. The basket can rotate at various speeds to agitate articles within the wash chamber in the washing fluid, to wring washing fluid from articles within the wash chamber, etc. Washing machine appliances include vertical axis washing machine appliances and horizontal axis washing machine appliances, where "vertical axis" and "horizontal axis" refer to the axis of rotation of the wash basket within the wash tub.

A concern during operation of washing machine appliances is the balance of the basket and contents thereof, e.g., a load of articles and wash liquid, during operation. For example, the articles and wash liquid within the basket may not be equally weighted about a central axis of the basket and tub. Accordingly, when the basket rotates, in particular during a spin cycle, the imbalance in weight may cause the basket to be out-of-balance within the tub, such that the axis of rotation does not align with the central axis of the basket or tub. Such out-of-balance issues during rotation of the basket can cause excessive noise, vibration or motion, or other undesired conditions.

Further, a type of the load of articles, e.g., a material type and the absorbency of the material of the articles, may influence the behavior of the articles and wash liquid during the spin cycle. In particular, when the load includes one or more non-shedding articles, e.g., articles which are waterproof or very low water absorbency, wash liquid may be retained within the basket up to a certain rotational speed (such as entrapped within folds of a non-shedding article) and then, as the rotation accelerates, the wash liquid may be rapidly displaced within or from the basket, causing a sudden shift in the center of mass of the contents of the basket. Such shifting of the center of mass may result in an increased likelihood of an out-of-balance condition.

Accordingly, a laundry appliance having improved features for determining whether a load of articles therein includes non-shedding articles would be desired.

BRIEF DESCRIPTION OF THE INVENTION

Aspects and advantages of the invention will be set forth in part in the following description, or may be obvious from the description, or may be learned through practice of the invention.

In one aspect of the present disclosure, a method of operating a washing machine appliance is provided. The method includes operating a motor of the washing machine appliance in order to rotate a basket of the washing machine appliance to a first speed. The method also includes decelerating the basket from the first speed to a second speed less than the first speed and determining a deceleration time of the basket while decelerating the basket from the first speed to the second speed. The method further includes determining a size of a load of articles in the basket of the washing machine appliance based on the deceleration time. Based on the determined size of the load, one or more operating parameters of the washing machine appliance are selected, and the method also includes performing an operation of the washing machine appliance according to the one or more selected operating parameters.

In another aspect of the present disclosure, a washing machine appliance is provided. The washing machine appliance includes a basket rotatably mounted within the washing machine appliance and a motor coupled to the basket whereby the motor is operable for rotating the basket. The washing machine appliance also includes a controller. The controller is in operative communication with the motor. The controller is configured for operating the motor of the washing machine appliance in order to rotate the basket of the washing machine appliance to a first speed. The controller is also configured for decelerating the basket from the first speed to a second speed less than the first speed and determining a deceleration time of the basket while decelerating the basket from the first speed to the second speed. The controller is further configured for determining a size of the load of articles in the basket of the washing machine appliance based on the deceleration time. Based on the size of the load, the controller is configured for selecting one or more operating parameters of the washing machine appliance, and the controller is also configured for performing an operation of the washing machine appliance according to the one or more selected operating parameters.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
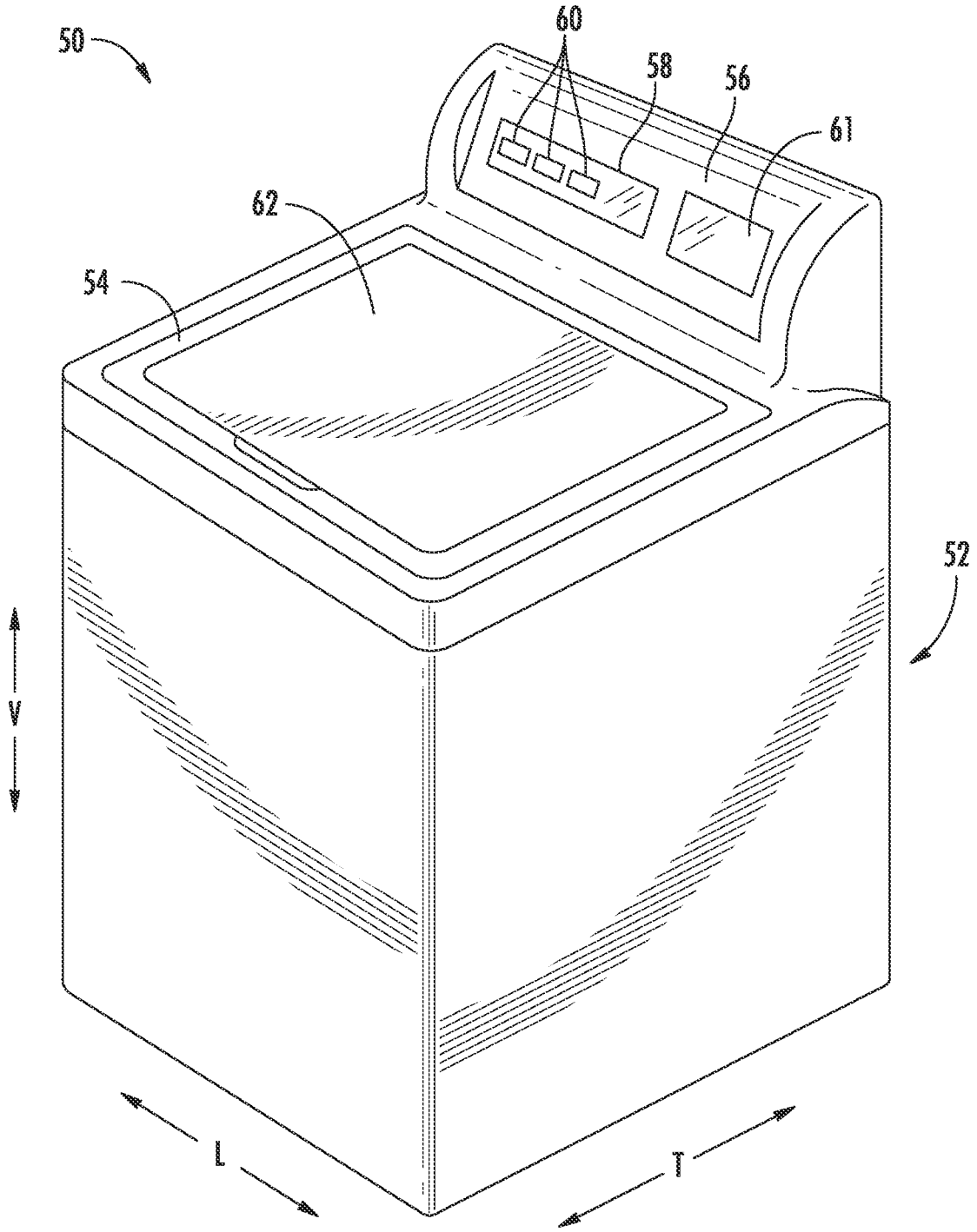
FIG. 1 provides a perspective view of a washing machine appliance according to one or more exemplary embodiments of the present subject matter.

Reference now will be made in detail to embodiments of the invention, one or more examples of which are illustrated in the drawings. Each example is provided by way of explanation of the invention, not limitation of the invention.

In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "substantially," "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

As used herein, the terms "articles," "clothing," or "laundry" include but need not be limited to fabrics, textiles, garments, linens, papers, or other items which may be cleaned, dried, and/or otherwise treated in a laundry appliance. Furthermore, the term "load" or "laundry load" refers to the combination of clothing that may be washed together in a washing machine appliance or dried together in a dryer appliance (e.g., clothes dryer), including washed and dried together in a combination laundry appliance, and may include a mixture of different or similar articles of clothing of different or similar types and kinds of fabrics, textiles, garments and linens within a particular laundering process.

FIG. 1 is a perspective view of a washing machine appliance 50 according to an exemplary embodiment of the present subject matter. As illustrated, washing machine appliance 50 generally defines a vertical direction V, a lateral direction L, and a transverse direction T, each of which is mutually perpendicular, such that an orthogonal coordinate system is generally defined. As may be seen in FIG. 1, washing machine appliance 50 includes a cabinet 52 and a cover 54. A backsplash 56 extends from cover 54, and a control panel 58 including a plurality of input selectors is coupled to backsplash 56. Control panel 58 and input selectors 60 collectively form a user interface input for operator selection of machine cycles and features, and in one embodiment, a display 61 indicates selected features, a countdown timer, and/or other items of interest to machine users. A lid 62 is mounted to cover 54 and is rotatable between an open position (not shown) facilitating access to a wash tub 64 (FIG. 2) located within cabinet 52 and a closed position (shown in FIG. 1) forming an enclosure over wash tub 64.

Figure 2:
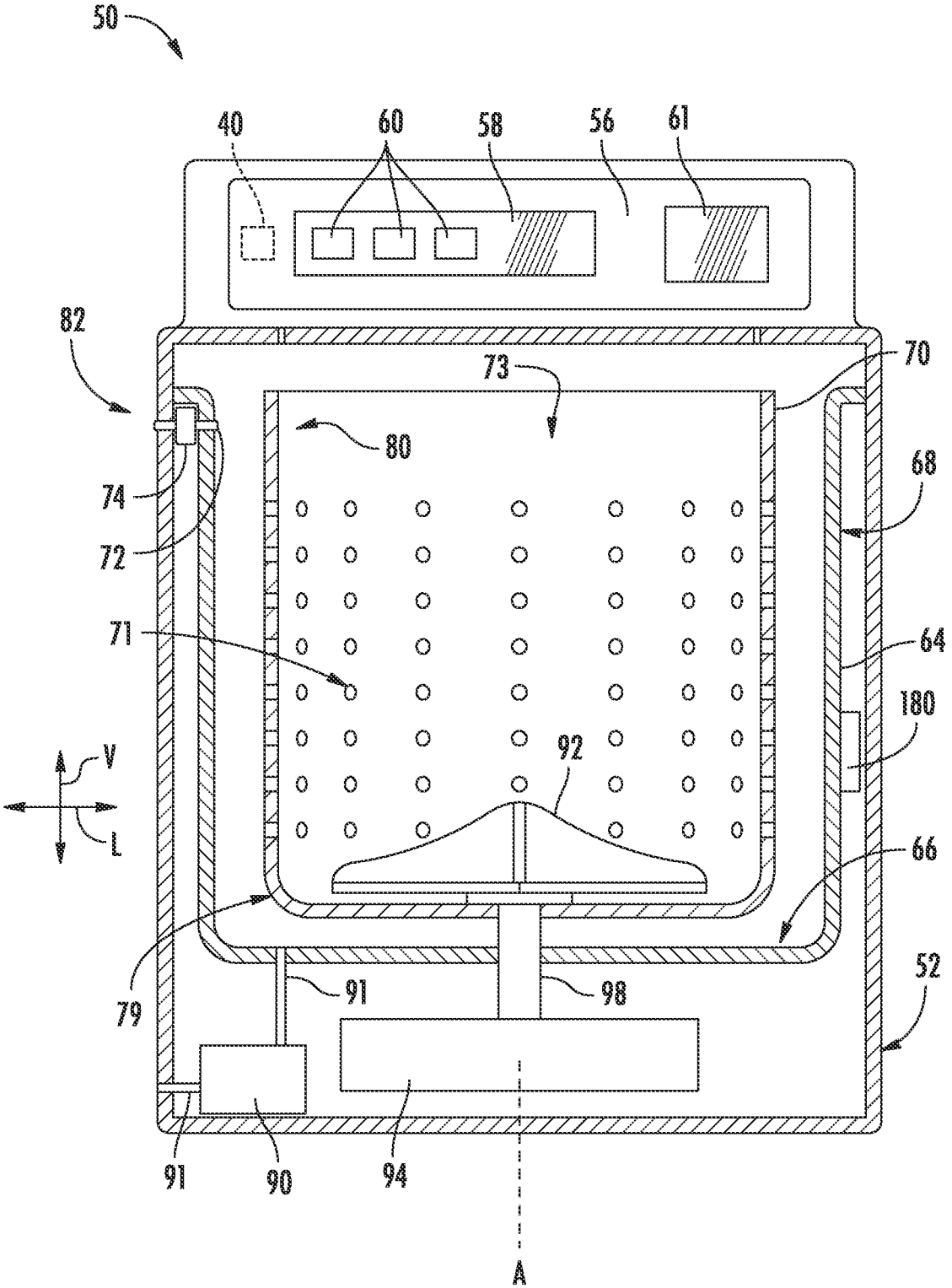
FIG. 2 provides a front, section view of the exemplary washing machine appliance of FIG. 1.

FIG. 2 provides a front, cross-section view of washing machine appliance 50. As may be seen in FIG. 2, wash tub 64 includes a bottom wall 66 and a sidewall 68. A wash basket 70 is rotatably mounted within wash tub 64. In particular, wash basket 70 is rotatable about an axis of rotation A which, in the illustrated embodiment of FIGS. 1 and 2, is generally parallel to the vertical direction V. Thus, washing machine appliance 50 may be referred to as a vertical axis washing machine appliance. Wash basket 70 defines a wash chamber 73 for receipt of articles for washing and extends, e.g., vertically, between a bottom portion 79 and a top portion Wash basket 70 includes a plurality of perforations 71 therein to facilitate fluid communication between an interior of wash basket 70 and wash tub 64.

A spout 72 is configured for directing a flow of fluid into wash tub 64. In particular, spout 72 may be positioned at or adjacent top portion 80 of wash basket 70. Spout 72 may be in fluid communication with a water supply (not shown) in order to direct fluid (e.g., clean water) into wash tub 64 and/or onto articles within wash chamber 73 of wash basket 70. A valve 74 regulates the flow of fluid through spout 72. For example, valve 74 can selectively adjust to a closed position in order to terminate or obstruct the flow of fluid through spout 72. A pump assembly 90 (shown schematically in FIG. 2) is located beneath tub 64 and wash basket 70 for gravity assisted flow from wash tub 64. Pump 90 may be positioned along or in operative communication with a drain line 91 which provides fluid communication from the wash chamber 73 of the basket 70 to an external conduit, such as a wastewater line (not shown). In some embodiments, the pump 90 may also or instead be positioned along or in operative communication with a recirculation line (not shown) which extends back to the tub 64, e.g., in addition to the drain line 91.

An agitation element 92, shown as an impeller in FIG. 2, is disposed in wash basket 70 to impart an oscillatory motion to articles and liquid in wash chamber 73 of wash basket 70. In various exemplary embodiments, agitation element 92 includes a single action element (i.e., oscillatory only), double action (oscillatory movement at one end, single direction rotation at the other end) or triple action (oscillatory movement plus single direction rotation at one end, single direction rotation at the other end). As illustrated in FIG. 2, agitation element 92 is oriented to rotate about axis of rotation A. Wash basket 70 and agitation element 92 are driven by a pancake motor 94. As motor output shaft 98 is rotated, wash basket 70 and agitation element 92 are operated for rotatable movement within wash tub 64, e.g., about the axis of rotation A. Washing machine appliance 50 may also include a brake assembly (not shown) selectively applied or released for respectively maintaining wash basket 70 in a stationary position within wash tub 64 or for allowing wash basket 70 to spin within wash tub 64.

Operation of washing machine appliance 50 is controlled by a processing device or controller 40 that is operatively coupled to the user interface input located on washing machine backsplash 56 for user manipulation to select washing machine cycles and features. In response to user manipulation of the user interface input, controller 40 operates the various components of washing machine appliance 50 to execute selected machine cycles and features.

Controller 40 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 40 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 may be in communication with controller 40 via one or more signal lines or shared communication busses. In particular, controller 40 may be communicatively coupled with one or more sensors, e.g., a temperature sensor, pressure sensor, etc., and/or measurement devices, such as measurement device 180 illustrated in FIG. 2.

In an illustrative embodiment, laundry items are loaded into wash chamber 73 of wash basket 70, and washing operation is initiated through operator manipulation of control input selectors 60. Wash tub 64 is filled with water and mixed with detergent to form a wash fluid. Valve 74 can be opened to initiate a flow of water into wash tub 64 via spout 72, and wash tub 64 can be filled to the appropriate level for the amount of articles being washed. Once wash tub 64 is properly filled with wash fluid, the contents of the wash basket 70 are agitated with agitation element 92 for cleaning of laundry items in wash basket 70. More specifically, agitation element 92 is moved back and forth in an oscillatory motion. The wash fluid may be recirculated through the washing machine appliance 50 at various points in the wash cycle, such as before or during the agitation phase (as well as one or more other portions of the wash cycle, separately or in addition to before and/or during the agitation phase).

After the agitation phase of the wash cycle is completed, wash tub 64 is drained. Laundry articles can then be rinsed by again adding fluid to wash tub 64, depending on the particulars of the cleaning cycle selected by a user, agitation element 92 may again provide agitation within wash basket 70. One or more spin cycles may also be used. In particular, a spin cycle may be applied after the wash cycle and/or after the rinse cycle in order to wring wash fluid from the articles being washed. During a spin cycle, wash basket 70 is rotated at relatively high speeds. In various embodiments, the pump 90 may be activated to drain liquid from the washing machine appliance 50 during the entire drain phase (or the entirety of each drain phase, e.g., between the wash and rinse and/or between the rinse and the spin) and may be activated during one or more portions of the spin cycle.

While described in the context of a specific embodiment of washing machine appliance 50, using the teachings disclosed herein it will be understood that washing machine appliance 50 is provided by way of example only. Other washing machine appliances having different configurations (such as horizontal-axis washing machine appliances), different appearances, and/or different features may also be utilized with the present subject matter as well.

Figure 3:
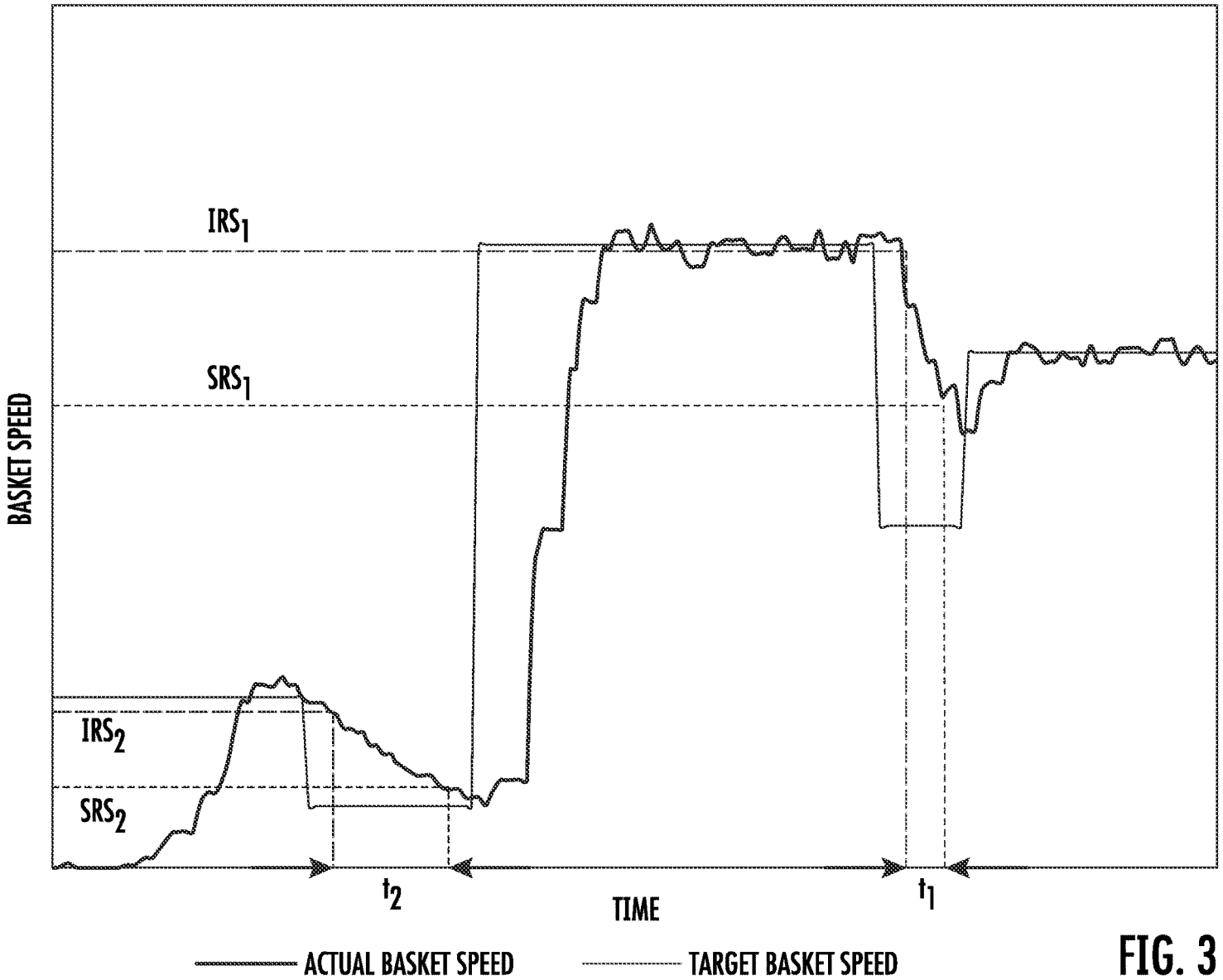
FIG. 3 provides a plot of a basket speed over time during an exemplary operation of a washing machine appliance.

Referring now to FIG. 3, an exemplary plot of basket speed over time during an exemplary operation of a washing machine appliance according to one or more embodiments of the present disclosure is provided. The basket speed may be a rotational speed, e.g., in revolutions per minute (RPM), and the time may be on the order of minutes and seconds. For example, the operation illustrated in FIG. 3 may be a load-sizing operation, and the load-sizing operation may be a preliminary or beginning portion of a cycle of the washing machine appliance, e.g., wherein the total time of the load-sizing operation may be about five minutes or less, such as about three minutes or less, such as about two minutes and thirty seconds or less, such as about one minute or less, such as about thirty seconds. For example, the load-sizing operation may be used to automatically select or determine certain parameters for other operations, such as other subsequent portions of the cycle. In some exemplary embodiments, the load-sizing operation may be used, e.g., to determine whether a non-shedding load algorithm is performed.

In particular, FIG. 3 illustrates a plot of target basket speed and actual basket speed during the exemplary operation. The target basket speed may be a speed setting or speed command, such as a commanded speed based on a command from the controller of the washing machine appliance to the motor of the washing machine appliance. The actual basket speed may be a measured basket speed, such as measured by or with one or more measurement devices 180 (FIG. 2), such as an accelerometer.

In some embodiments, e.g., as illustrated in FIG. 3, the operation may include decelerating the basket, such as from a first actual speed to a second actual speed less than the first actual speed and measuring the time it takes for the basket to decelerate, where "decelerate" is used herein throughout to include decreasing the speed of the basket by any means or combination of means, such as active braking, passive braking, and/or coasting. The measured deceleration time may be taken between multiple reference speeds. For example, the first actual speed may be an Initial Reference Speed (IRS) or may be greater than the IRS, and the second actual speed may be a Secondary Reference Speed (SRS) or may be less than the SRS. In some embodiments, the measured deceleration time may be the time over which the basket decelerates from the IRS to the SRS.

In some embodiments, e.g., as illustrated in FIG. 3, the IRS may be between about one hundred revolutions per minute (100 RPM) and about two hundred revolutions per minute (200 RPM), such as between about one hundred and twenty revolutions per minute (120 RPM) and about one hundred and eighty revolutions per minute (180 RPM), such as about one hundred and forty revolutions per minute (140 RPM) or about one hundred and fifty revolutions per minute (150 RPM), and the SRS may be between about seventy five revolutions per minute (75 RPM) and about one hundred and fifty revolutions per minute (150 RPM), such as between about one hundred revolutions per minute (100 RPM) and about one hundred and twenty revolutions per minute (120 RPM), such as about one hundred and ten revolutions per minute (110 RPM), or about one hundred revolutions per minute (100 RPM), where the SRS is less than the IRS. As mentioned, the first actual speed may be greater than the IRS, e.g., as illustrated in FIG. 3 the actual speed is slightly above the first Initial Reference Speed ($IRS_1$) before the speed begins to decrease and crosses the $IRS_1$. In the example embodiment illustrated in FIG. 3, the deceleration time of the exemplary load may be $t_1$, e.g., the time over which the actual basket speed decreases from the $IRS_1$ to the $SRS_1$, as indicated in FIG. 3. Further, the deceleration time, e.g., $t_1$, may be a first deceleration time. For example, FIG. 3 also illustrates a third actual speed which is slightly above a second Initial Reference Speed ($IRS_2$) and a fourth actual speed which is slightly below a second Secondary Reference Speed ($SRS_2$) in the exemplary operation of FIG. 3. In such embodiments, the third speed may be a second IRS ($IRS_2$) for a second deceleration time $t_2$ and the fourth speed may be a second SRS ($SRS_2$) for the second deceleration time $t_2$. Including multiple deceleration times may advantageously increase the accuracy of a load size determination based on the deceleration times. In some embodiments, $IRS_2$ may be between about fifteen revolutions per minute (15 RPM) and about ninety revolutions per minute (90 RPM), such as between about twenty revolutions per minute (20 RPM) and about eighty revolutions per minute (80 RPM), such as between about twenty revolutions per minute (20 RPM) and about eighty revolutions per minute (80 RPM), such as about sixty revolutions per minute (60 RPM), or about forty revolutions per minute (40 RPM), and $SRS_2$ may be between about zero revolutions per minute (0 RPM) and about seventy five revolutions per minute (75 RPM), such as between about ten revolutions per minute (10 RPM) and about sixty revolutions per minute (60 RPM), such as between about twenty revolutions per minute (20 RPM) and about forty revolutions per minute (40 RPM), such as about twenty revolutions per minute (20 RPM), or about fifteen revolutions per minute (15 RPM). It should be noted that although the possible values for IRS and SRS may overlap, in each case the SRS will be less than a respective IRS when actual values to be implemented are selected from the ranges of possibilities for each speed.

In various embodiments, the first actual speed may be any suitable speed and the second actual speed may be any suitable speed less than the first actual speed, down to and including zero revolutions per minute (0 RPM). Further, the range between the reference speeds, e.g., the difference between the IRS and SRS in any set of values, e.g., $IRS_1$ minus $SRS_1$ or $IRS_2$ minus $SRS_2$, may be any suitable value. In some embodiments, the second speed may be greater than zero.

In some embodiments, decelerating the basket from the first actual speed to the second actual speed may include coasting from the first actual speed to the second actual speed. As illustrated in FIG. 3, the target basket speed may be set to a first target speed, e.g., to the IRS or above the IRS, and, after the actual basket speed has reached to or about the first target speed, the basket may then be decelerated, e.g., allowed to coast, by setting the target basket speed to a lower value, e.g., to the SRS or below the SRS.

As mentioned, the deceleration time may be measured as the time it takes for the actual basket speed to decrease from the IRS to the SRS. The deceleration time may be proportional to the mass and the inertia of the basket and the load therein. For example, a longer deceleration time, e.g., coast time, corresponds to a larger load having greater inertia, whereas a shorter deceleration time corresponds to a smaller load having less inertia. The deceleration time, e.g., coast time, may thereby be used to determine a size of the load of articles. For example, when the coast time is less than a threshold time, the load of articles may be identified as a small load.

Figure 4:
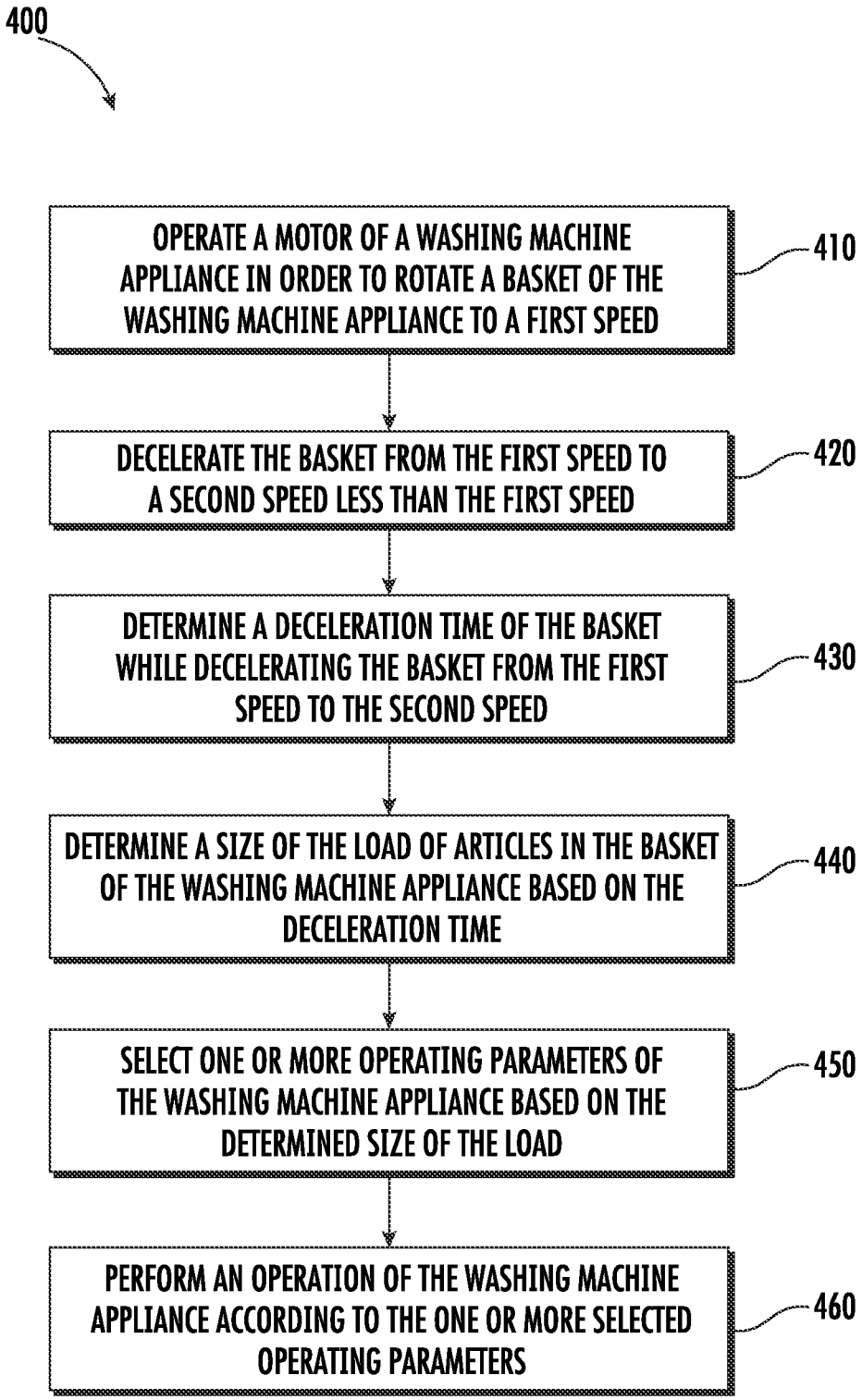
FIG. 4 provides a flow chart illustrating a method for operating a washing machine appliance in accordance with one or more exemplary embodiments of the present disclosure.

Turning now to FIG. 4, embodiments of the present disclosure may also include methods of operating a washing machine appliance, such as the example method 400 illustrated in FIG. 4. Such methods may be used with any suitable washing machine appliance, such as washing machine appliance 50, as described above.

For example, as mentioned above, the washing machine appliance 50 may include a controller 40 and the controller 40 may be operable for, e.g., configured for, performing some or all of the methods and/or steps thereof described herein. For example, one or more method steps may be embodied as an algorithm or program stored in a memory of the controller 40 and executed by the controller 40 in response to a user input such as a selection of a wash operation or rinse operation, etc., of the washing machine appliance 50.

As illustrated in FIG. 4, in some embodiments, the method 400 may include a step 410 of operating a motor of the washing machine appliance in order to rotate a basket of the washing machine appliance to a first speed. For example, the method 400 may include operating the motor to accelerate the basket up to the first speed or about the first speed and may, in some embodiments, further include operating the motor to rotate the basket at the first speed for a holding period. For example, the holding period may occur prior to decelerating the basket, e.g., as described below with respect to step 420 in FIG. 4.

Method 400 may also include a step 420 of decelerating the basket from the first speed to a second speed less than the first speed, where the first speed and the second speed should be understood as referring to actual speeds, such that the deceleration is an actual deceleration, such as between actual, measured, basket speeds. For example, decelerating the basket may include allowing the basket to coast. Allowing the basket to coast generally includes not driving the basket, e.g., with the motor of the washing machine appliance, while also not providing or applying any braking, e.g., without passive braking. For example, allowing the basket to coast may include deactivating the motor and may also include disengaging or decoupling the motor from the basket, such as disengaging a drive coupling between the motor and the basket, or disengaging a brake.

Method 400 may further include determining a deceleration time of the basket while decelerating the basket from the first speed to the second speed. The deceleration time may, in various embodiments, be the total time to decelerate from the first speed to the second speed or may be measured during a portion of the deceleration of the basket from the first speed to the second speed. For example, when the first speed is equal to the IRS (Initial Reference Speed, e.g., as described above with reference to FIG. 3) and the second speed is equal to the SRS (Secondary Reference Speed, e.g., as described above with reference to FIG. 3), the deceleration time may be the full amount of time that the basket decelerates from the first speed to the second speed. In additional embodiments, e.g., where the first speed is greater than the IRS and/or the second speed is less than the SRS, the deceleration time may be less than the total time to decelerate from the first speed to the second speed, such as the deceleration time may correspond to the portion of the total deceleration that starts when the actual basket speed is at or about the IRS and ends when the actual basket speed is at or about the SRS.

Method 400 may also include determining a size of the load of articles in the basket of the washing machine appliance based on the deceleration time, e.g., as indicated at 440 in FIG. 4. In some embodiments, the size of the load of articles may be determined based one or more deceleration times. For example, steps 420 and 430 may be reiterated prior to determining the size of the load of articles in the basket of the washing machine appliance. In some embodiments, the speeds may vary across one or more iterations. For example, the deceleration time of step 430 may be a first deceleration time and method 400 may also include, after determining the first deceleration time, operating the motor of the washing machine appliance in order to rotate the basket of the washing machine appliance to a third speed. In such embodiments, the third speed may be different from the first speed. The method 400 may then include decelerating the basket from the third speed to a fourth speed less than the third speed, and determining a second deceleration time of the basket while decelerating the basket from the third speed to the fourth speed. In such embodiments, the step 440 of determining the size of the load may include determining the size of the load based on multiple deceleration times, e.g., based on the first deceleration time and the second deceleration time.

Determining the size of the load of articles may permit responsive or tailored laundry operations. For example, the method 400 may include selecting one or more operating parameters of the washing machine appliance based on the determined size of the load, e.g., as indicated at 450 in FIG. 4, such as to provide optimized handling of the load by applying operating parameters that are custom-tuned or calibrated for the specific amount of laundry, e.g., the size of the load of articles, in the basket. Thus, exemplary embodiments of method 400 may further include performing an operation of the washing machine appliance according to the one or more selected operating parameters, e.g., as indicated at 460 in FIG. 4.

In some embodiments, various operating parameters may be automatically selected or adjusted based on the determined size of the load, such as a maximum speed for a spin cycle, a fill volume, an agitation setting (e.g., oscillation length for an agitator in the washing machine appliance), a spin time (e.g., a time limit for a spin cycle), a soak or dwell time, and/or other appropriate operating parameters for the washing machine appliance as will be recognized by those of ordinary skill in the art. For example, the fill volume may be a rinse fill, a wash fill, and/or other fill volumes in an operation of the washing machine appliance.

In some embodiments, the determination of the load size may be a high-pass selection of load sizes, such as where load sizes above a certain threshold size receive special treatment or different treatment than loads having a load size below (e.g., less than or equal to) the threshold size. In some embodiments, determining a size of the load of articles in the basket of the washing machine appliance may include determining whether the load is a small load. For example, the threshold size may be determined based on a threshold coast time, such as loads having a coast time less than or equal to the threshold coast time may be determined to be small loads. Further, the washing machine appliance may be configured for, and methods of operating the washing machine appliance may include, detecting a load type of the load of articles in the basket of the washing machine appliance, such as detecting whether the load is a non-shedding load.

For example, embodiments of the present disclosure may include a non-shedding load algorithm, which may include detecting a non-shedding load and additional steps to reduce the likelihood of an out-of-balance condition occurring when the non-shedding load is detected, such as limiting the maximum rotation speed of the basket, e.g., during the spin cycle, when the non-shedding load is detected. However, the load type, e.g., non-shedding load, may be more readily detected, such as more easily distinguished from a water shedding load, above a certain load size threshold, e.g., a non-shedding load detection threshold. Thus, in some embodiments, the one or more operating parameters of the washing machine appliance which are selected at 450 may include a non-shedding load detection algorithm, and selecting the one or more operating parameters of the washing machine appliance based on the determined size of the load may include selecting the non-shedding load algorithm when the determined load size is greater than the non-shedding load detection threshold. In such embodiments, performing the operation of the washing machine appliance according to the selected one or more operating parameters may include running the non-shedding load detection algorithm.

In additional embodiments, multiple thresholds or classifications may be applied. Thus, for example, determining the size of the load of articles in the basket of the washing machine appliance may include determining whether the load is a small load, a medium load, or a large load, etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a washing machine appliance, the method comprising:

operating a motor of the washing machine appliance in order to rotate a basket of the washing machine appliance to a first speed;

decelerating the basket from the first speed to a second speed less than the first speed;

determining a first deceleration time of the basket while decelerating the basket from the first speed to the second speed;

operating the motor of the washing machine appliance in order to rotate the basket of the washing machine appliance to a third speed, the third speed different from the first speed;

decelerating the basket from the third speed to a fourth speed less than the third speed;

determining a second deceleration time of the basket while decelerating the basket from the third speed to the fourth speed;

determining a size of a load of articles in the basket of the washing machine appliance based on the first deceleration time and the second deceleration time;

selecting one or more operating parameters of the washing machine appliance based on the determined size of the load; and performing an operation of the washing machine appliance according to the one or more selected operating parameters.

2. The method of claim 1, wherein the selected one or more operating parameters of the washing machine appliance based on the determined size of the load comprises a time limit for a spin cycle.

3. The method of claim 1, wherein the selected one or more operating parameters of the washing machine appliance based on the determined size of the load comprises a maximum speed for a spin cycle.

4. The method of claim 1, wherein the selected one or more operating parameters of the washing machine appliance based on the determined size of the load comprises a fill volume.

5. The method of claim 1, wherein determining the size of the load of articles comprises determining the size of the load of articles is greater than a non-shedding load detection threshold, wherein the one or more operating parameters of the washing machine appliance comprises a non-shedding load detection algorithm, and wherein performing the operation of the washing machine appliance comprises running the non-shedding load detection algorithm.

6. The method of claim 1, wherein decelerating the basket comprises coasting the basket from the first speed to the second speed.

7. The method of claim 1, wherein the first speed is greater than an initial reference speed, the initial reference speed is greater than the second speed, and wherein determining the deceleration time comprises determining an amount of time for the basket to decelerate from the initial reference speed to the second speed.

8. The method of claim 1, wherein the second speed is greater than zero.

9. The method of claim 1, further comprising operating the motor to rotate the basket at the first speed for a holding period prior to decelerating the basket.

10. A washing machine appliance, comprising:

a basket rotatably mounted within the washing machine appliance;

a motor coupled to the basket whereby the motor is operable for rotating the basket; and a controller in operative communication with the motor, the controller configured for:

operating the motor of the washing machine appliance in order to rotate the basket of the washing machine appliance to a first speed;

decelerating the basket from the first speed to a second speed less than the first speed;

determining a first deceleration time of the basket while decelerating the basket from the first speed to the second speed;

operating the motor of the washing machine appliance in order to rotate the basket of the washing machine appliance to a third speed, the third speed different from the first speed;

decelerating the basket from the third speed to a fourth speed less than the third speed;

determining a second deceleration time of the basket while decelerating the basket from the third speed to the fourth speed;

determining a size of a load of articles in the basket of the washing machine appliance based on the first deceleration time and the second deceleration time;

selecting one or more operating parameters of the washing machine appliance based on the determined size of the load; and performing an operation of the washing machine appliance according to the one or more selected operating parameters.

11. The washing machine appliance of claim 10, wherein the selected one or more operating parameters of the washing machine appliance based on the determined size of the load comprises a time limit for a spin cycle.

12. The washing machine appliance of claim 10, wherein the selected one or more operating parameters of the washing machine appliance based on the determined size of the load comprises a maximum speed for a spin cycle.

13. The washing machine appliance of claim 10, wherein the selected one or more operating parameters of the washing machine appliance based on the determined size of the load comprises a fill volume.

14. The washing machine appliance of claim 10, wherein determining the size of the load of articles comprises determining the size of the load of articles is greater than a non-shedding load detection threshold, wherein the one or more operating parameters of the washing machine appliance comprises a non-shedding load detection algorithm, and wherein performing the operation of the washing machine appliance comprises running the non-shedding load detection algorithm.

15. The washing machine appliance of claim 10, wherein decelerating the basket comprises allowing the basket to coast from the first speed to the second speed.

16. The washing machine appliance of claim 10, wherein the first speed is greater than an initial reference speed, the initial reference speed is greater than the second speed, and wherein determining the deceleration time comprises determining an amount of time for the basket to decelerate from the initial reference speed to the second speed.

17. The washing machine appliance of claim 10, wherein the second speed is greater than zero.

18. The washing machine appliance of claim 10, further comprising operating the motor to rotate the basket at the first speed for a holding period prior to decelerating the basket.

* * * * *